US011732507B2

(12) United States Patent
Ma et al.

(10) Patent No.: US 11,732,507 B2
(45) Date of Patent: Aug. 22, 2023

(54) INTERCHANGEABLE CORE LOCK ASSEMBLIES

(71) Applicant: Delta Lock Company, LLC, Bohemia, NY (US)

(72) Inventors: Alvin Ma, Selden, NY (US); William H. Bullwinkel, Farmingdale, NY (US)

(73) Assignee: Innovation Lock, LLC, Palm Beach Gardens, FL (US)

( * ) Notice: Subject to any disclaimer, the term of this patent is extended or adjusted under 35 U.S.C. 154(b) by 419 days.

(21) Appl. No.: 17/070,979

(22) Filed: Oct. 15, 2020

(65) Prior Publication Data

US 2021/0025196 A1 Jan. 28, 2021

Related U.S. Application Data

(63) Continuation of application No. 16/939,134, filed on Jul. 27, 2020, which is a continuation of application No. 15/607,573, filed on May 29, 2017, now Pat. No. 10,724,276.

(60) Provisional application No. 62/344,692, filed on Jun. 2, 2016.

(51) Int. Cl.

| | |
|---|---|
| ***E05B 9/04*** | (2006.01) |
| ***E05B 63/00*** | (2006.01) |
| ***E05B 35/08*** | (2006.01) |
| ***E05B 27/00*** | (2006.01) |
| ***E05B 9/08*** | (2006.01) |
| ***E05B 65/00*** | (2006.01) |

(52) U.S. Cl.

CPC ..... *E05B 63/0056* (2013.01); *E05B 9/04* (2013.01); *E05B 9/08* (2013.01); *E05B 27/005* (2013.01); *E05B 27/0007* (2013.01); *E05B 35/08* (2013.01); *E05B 65/0025* (2013.01)

(58) Field of Classification Search

CPC .... E05B 63/0056; E05B 65/0025; E05B 9/04; E05B 9/08; E05B 27/0007; E05B 27/005; E05B 35/08; B60R 16/0222; Y10T 70/7655; Y10T 70/7661

USPC ..... 70/370, 371, 375, 451, 452

See application file for complete search history.

(56) References Cited

U.S. PATENT DOCUMENTS

| | | | |
|---|---|---|---|
| 100,738 | A | 3/1870 | Dwight |
| 884,260 | A | 4/1908 | Boyd |
| 1,864,883 | A | 6/1932 | Edward |

(Continued)

FOREIGN PATENT DOCUMENTS

| | | | |
|---|---|---|---|
| DE | 3233976 | C1 | 8/1983 |

*Primary Examiner* — Suzanne L Barrett

(74) *Attorney, Agent, or Firm* — Gerald Hespos; Michael Porco

(57) ABSTRACT

In one aspect of the present disclosure, a locking device is provided including an interchangeable core (IC), a barrel, an anti-rotation plate, a prong driver, a bolt and a backplate. The barrel is coupled to the backplate and includes a hollow interior to receive the IC. The bolt is slidably disposed in a slot of the backplate. The IC includes a key hole. The prong driver is coupled to the IC and the bolt, such that, when a proper key is inserted into the key hole and rotated the bolt can be extended from the slot in a direction away from the locking device or retracted into the slot in a direction toward the interior of the locking device. The anti-rotation plate of the locking device is coupled to the barrel to prevent the locking device from being rotated relative to a structure the locking device is mounted to.

10 Claims, 21 Drawing Sheets

(56) References Cited

U.S. PATENT DOCUMENTS

| | | | |
|---|---|---|---|
| 1,938,112 | A | 12/1933 | Schlage |
| 2,140,066 | A | 12/1938 | White |
| 2,275,362 | A | 3/1942 | Golden et al. |
| 2,720,102 | A | 10/1955 | Spain |
| 2,938,373 | A | 5/1960 | Gray et al. |
| 3,262,292 | A | 7/1966 | Glass |
| 3,345,838 | A | 10/1967 | Russell et al. |
| 3,423,968 | A | 1/1969 | Foote |
| 3,503,233 | A | 3/1970 | Russell et al. |
| 3,563,593 | A | 2/1971 | Leier et al. |
| 3,589,152 | A | 6/1971 | Glass et al. |
| 4,003,227 | A | 1/1977 | Casey |
| 4,009,599 | A | 3/1977 | Patriquin |
| 4,067,599 | A | 1/1978 | Ohno |
| 4,356,580 | A | 11/1982 | Kurtz |
| 4,617,810 | A | 10/1986 | Fish et al. |
| 4,630,457 | A | 12/1986 | Kincaid et al. |
| 4,672,827 | A | 6/1987 | Craig |
| 4,708,006 | A | 11/1987 | Hodgson |
| 4,756,638 | A | 7/1988 | Neyret |
| 4,768,360 | A | 9/1988 | Foshee |
| 4,809,525 | A | 3/1989 | Cox |
| 4,899,563 | A | 2/1990 | Martin |
| 4,920,774 | A | 5/1990 | Martin |
| 5,010,753 | A | 4/1991 | Boris |
| 5,038,589 | A | 8/1991 | Martin |
| 5,101,649 | A | 4/1992 | Duval |
| 5,121,619 | A | 6/1992 | Martin |
| 5,251,467 | A | 10/1993 | Anderson |
| 5,315,850 | A | 5/1994 | Edeus et al. |
| 5,548,981 | A | 8/1996 | Kirk |
| 5,590,555 | A | 1/1997 | Kester et al. |
| 5,615,566 | A | 4/1997 | Brandt |
| 5,657,652 | A | 8/1997 | Martin |
| 5,678,438 | A | 10/1997 | Kolkman et al. |
| 5,737,950 | A | 4/1998 | Yun-Bin |
| 5,813,260 | A | 9/1998 | Widen |
| 5,873,272 | A | 2/1999 | Thompson |
| 5,970,760 | A | 10/1999 | Shen |
| 6,035,673 | A | 3/2000 | Harrison |
| 6,079,241 | A | 6/2000 | Burleigh et al. |
| 6,161,404 | A | 12/2000 | Westwinkel |
| 6,393,882 | B1 | 5/2002 | Higgins |
| 6,523,379 | B2 | 2/2003 | Teskey |
| 6,606,890 | B1 | 8/2003 | Widen |
| 6,708,539 | B1 | 3/2004 | Widen |
| 6,920,770 | B2 | 7/2005 | Lurie et al. |
| 7,340,928 | B2 | 3/2008 | Hoffman |
| 7,716,958 | B2 | 5/2010 | Martin |
| 7,836,735 | B2 | 11/2010 | Liu |
| 7,874,189 | B2 | 1/2011 | Martin |
| 7,895,867 | B2 | 3/2011 | Hsieh |
| 8,028,555 | B2 | 10/2011 | Lurie |
| 8,444,100 | B2 | 5/2013 | Takahashi et al. |
| 8,776,557 | B2 | 7/2014 | Wang |
| 8,842,422 | B2 | 9/2014 | Hung et al. |
| 8,905,693 | B2 | 12/2014 | Coffland et al. |
| 8,919,156 | B1 | 12/2014 | Liu |
| 8,978,426 | B2 | 3/2015 | Wang |
| 9,234,369 | B2 | 1/2016 | Gupta et al. |
| 9,267,310 | B2 | 2/2016 | Linnåsen et al. |
| 9,816,289 | B2 | 11/2017 | Bullwinkel |
| 10,087,653 | B2 | 10/2018 | Bullwinkel |
| 10,184,270 | B2 | 1/2019 | Bullwinkel |
| 10,435,914 | B2 | 10/2019 | Ma |
| 2005/0011239 | A1 | 1/2005 | Lurie et al. |
| 2005/0271494 | A1 | 12/2005 | Hidalgo et al. |
| 2006/0086162 | A1 | 4/2006 | Huang |
| 2007/0227209 | A1 | 10/2007 | Massard et al. |
| 2009/0071209 | A1 | 3/2009 | Lurie |
| 2010/0031717 | A1* | 2/2010 | Lurie ..... E05B 9/084 70/385 |
| 2011/0127795 | A1 | 6/2011 | Still et al. |
| 2011/0132047 | A1 | 6/2011 | Terhaar et al. |
| 2011/0316325 | A1 | 12/2011 | Martin et al. |
| 2014/0037399 | A1 | 2/2014 | Hyatt |
| 2015/0176307 | A1 | 6/2015 | Bullwinkel |
| 2016/0281393 | A1 | 9/2016 | Bullwinkel et al. |
| 2017/0298651 | A1 | 10/2017 | Ma |

* cited by examiner

FIG. 5B A

INTERCHANGEABLE CORE LOCK ASSEMBLIES

PRIORITY

The present application is a continuation application of U.S. patent application Ser. No. 16/939,134, filed Jul. 27, 2020, which is a continuation application of U.S. patent application Ser. No. 15/607,573, filed May 29, 2017, now U.S. Pat. No. 10,724,276, which claims priority to U.S. Provisional Patent Application No. 62/344,692, filed Jun. 2, 2016, entitled "INTERCHANGEABLE CORE LOCK ASSEMBLIES", the contents of which are hereby incorporated by reference in its entirety.

TECHNICAL FIELD

The present disclosure relates generally to lock mechanisms, and more particularly, to lock assemblies for use with lock cylinders of interchangeable core cylinder types.

BACKGROUND

Numerous types of cylinders for locks are known and popularly used for various applications. For example, locks known in the industry as "interchangeable core cylinder" locks are used to provide a lock wherein the core cylinder can be removed from the lock housing through the use of a control key. A different interchangeable core cylinder can then be inserted into the lock housing, whereby the user can quickly and easily change a lock or locks without calling a locksmith. However, interchangeable core cylinder locks can often be large and cumbersome to operate. As a result, interchangeable core cylinder locks are not effectively implemented for use with showcase cabinets, drawers, and other more compact areas requiring locks. Therefore, a need exists for more efficient and compactly designed interchangeable core cylinder locks for various applications.

SUMMARY

Lock assemblies for use with lock cylinders of interchangeable core cylinder types are provided.

In one aspect of the present disclosure, a locking device is provided including: a barrel disposed along a longitudinal axis and including a first end, a second end, and an outer wall defining a hollow interior, the first end of the barrel configured to receive an interchangeable core, such that, the interchangeable core is retained in the hollow interior of the barrel; an anti-rotation plate coupled to the barrel and configured to prevent the locking device from being rotated relative to a structure the locking device is mounted to; the interchangeable core including a first end and a second end, the first end including a key hole; a prong driver including an engaging element, the prong driver coupled to the second end of the interchangeable core, such that, when a proper key is inserted into the key hole of the interchangeable core and rotated in a first direction, the engaging element of the prong driver is rotated in the first direction, and when the proper key is rotated in a second direction opposite the first direction, the engaging element of the prong driver is rotated in the second direction; a backplate coupled to the second end of the barrel, the backplate including a first slot; and a bolt slidably disposed in the first slot and including a second slot, the engaging element of the prong driver extending into the second slot, such that, when the prong driver is rotated in the first direction, the engaging element engages the second slot of the bolt to retract the bolt into the first slot in a direction toward the interior of the locking device and when the prong driver is rotated in the second direction, the engaging element engages the second slot of the bolt to extend the bolt outside of the first slot in a direction away from the locking device.

BRIEF DESCRIPTION OF THE DRAWINGS

The above and other aspects, features, and advantages of the present disclosure will become more apparent in light of the following detailed description when taken in conjunction with the accompanying drawings in which:

FIGS. 5A and 5B are rear views of the locking device of FIG. 1A in an unlocked position in accordance with an embodiment of the present disclosure;

It should be understood that the drawings are for purposes of illustrating the concepts of the disclosure and are not necessarily the only possible configuration for illustrating the disclosure.

DETAILED DESCRIPTION

Preferred embodiments of the present disclosure will be described hereinbelow with reference to the accompanying drawings. In the following description, well-known functions or constructions are not described in detail to avoid obscuring the present disclosure in unnecessary detail.

Figure 1A:
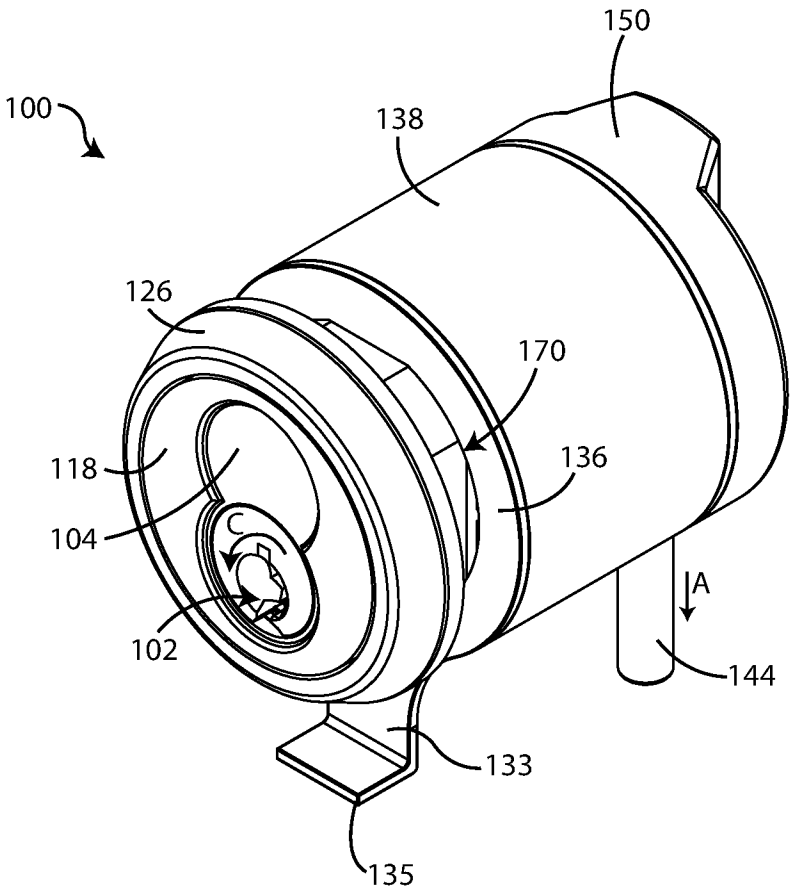
FIG. 1A is a perspective view of a locking device in a locked position in accordance with an embodiment of the present disclosure.
Figure 1B:
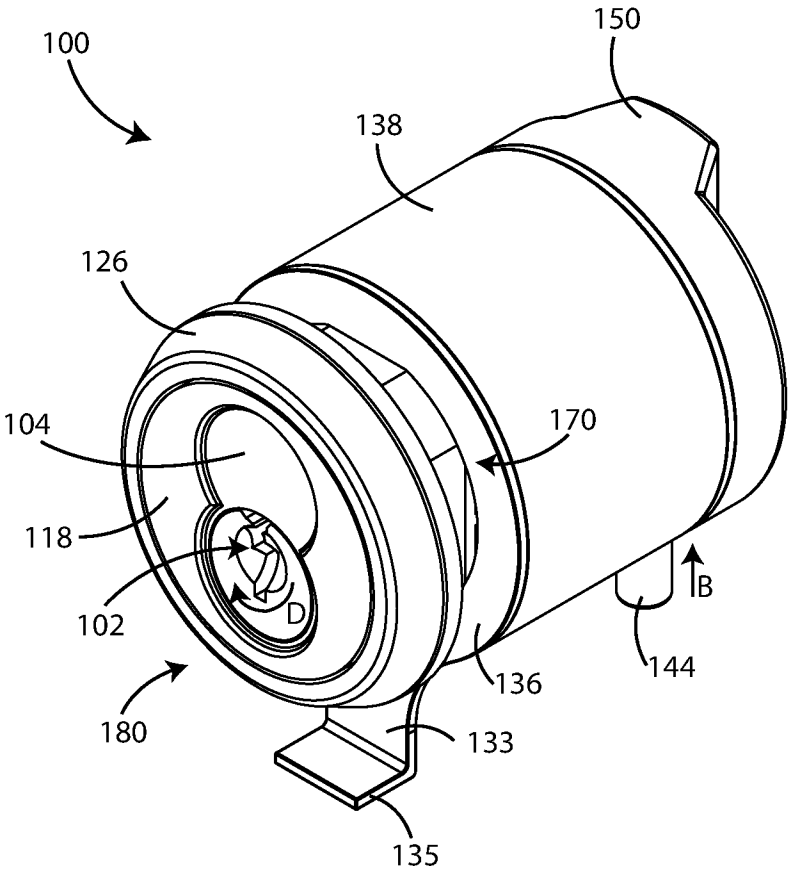
FIG. 1B is a perspective view of the locking device of FIG. 1A in an unlocked position in accordance with an embodiment of the present disclosure.

Referring to FIGS. 1A and 1B, a locking device 100 is shown in accordance with the present disclosure. FIG. 1A includes a perspective view of locking device 100 in a locked position and FIG. 1B includes a perspective view of locking device 100 in an unlocked position, as will be described in greater detail below.

Figure 2A:
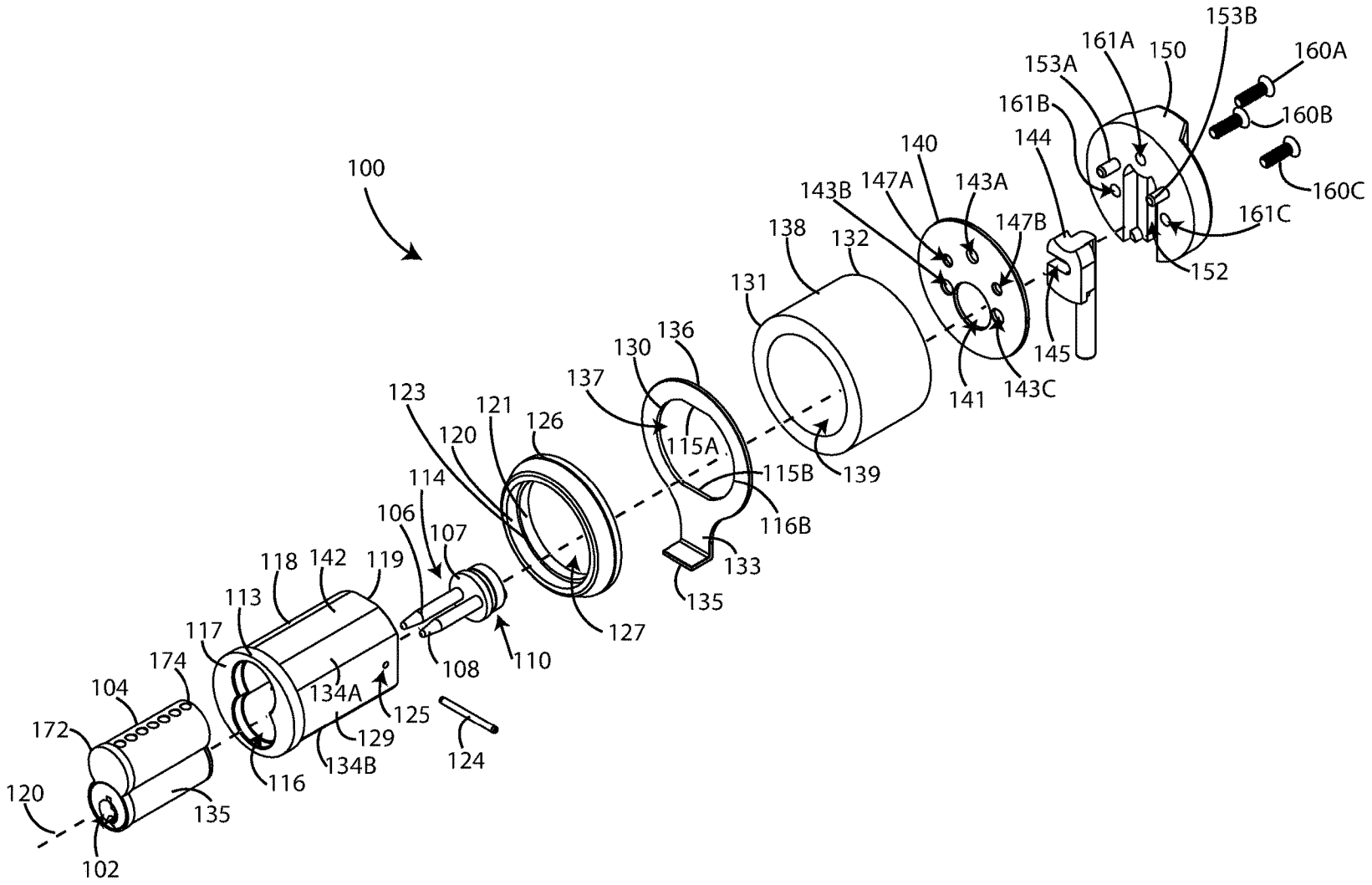
FIGS. 2A and 2B are exploded views of the locking device of FIG. 1A in accordance with an embodiment of the present disclosure.
Figure 2B:
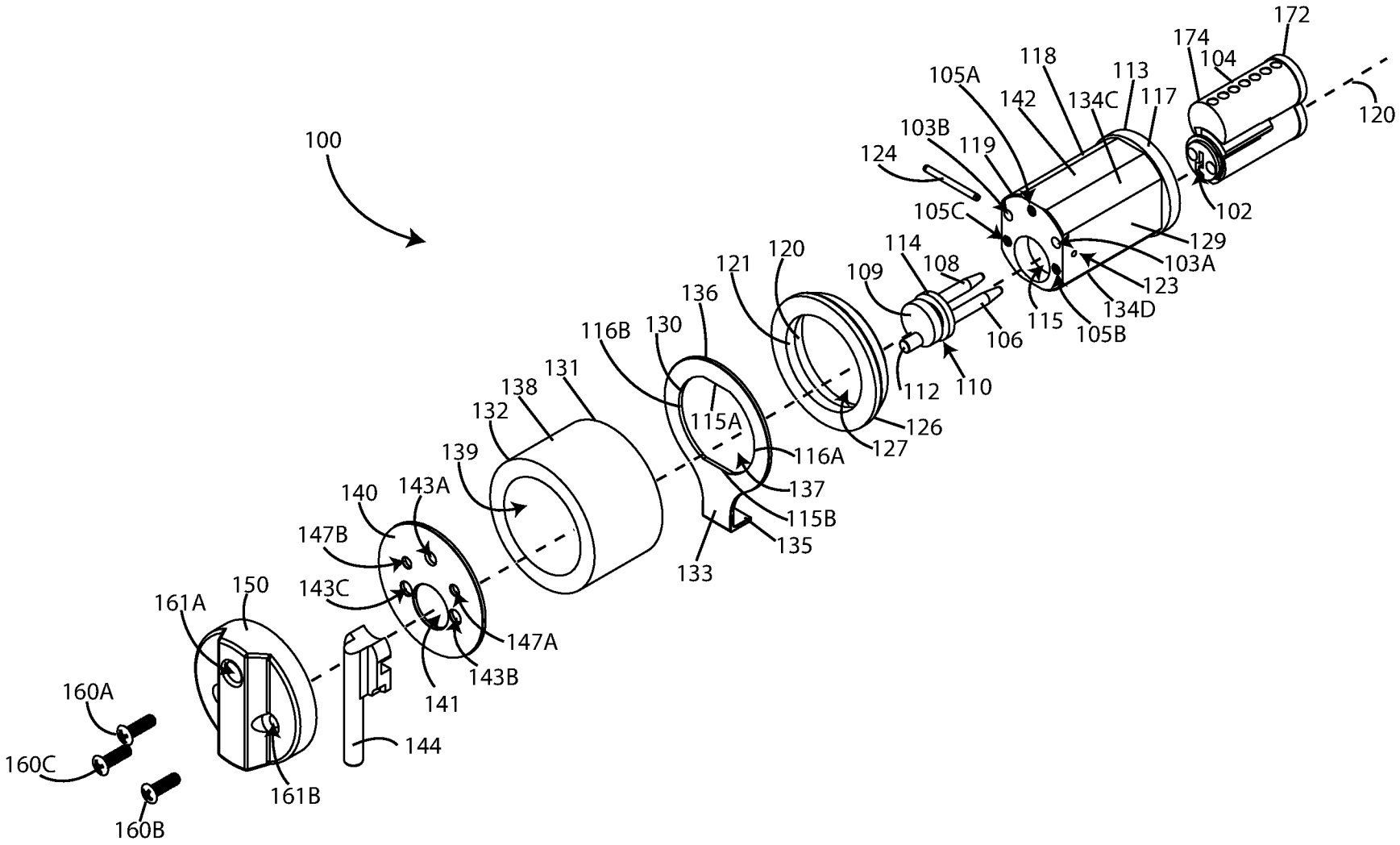

Referring to FIGS. 2A and 2B, exploded views of locking device 100 are shown in accordance with the present disclosure. Locking device 100 includes an interchangeable core 104, barrel 118, prong driver 114, flange 126, anti-rotation plate 136, dress sleeve 138, bolt retention plate 140, bolt 144, backplate 150 and assembly screws 160. The components of locking device 100 are shown disposed along longitudinal axis 120 in FIGS. 1A and 1B.

In one embodiment, interchangeable core 104 is configured as a small format interchangeable core (SFIC) however, it is to be appreciated that in other embodiments interchangeable core 104 may be configured as a large format interchangeable core or other type of interchangeable core in accordance with the present disclosure. SFIC 104 includes a key hole 102 and is disposed in the hollow interior 116 of barrel 118.

Figure 3B:
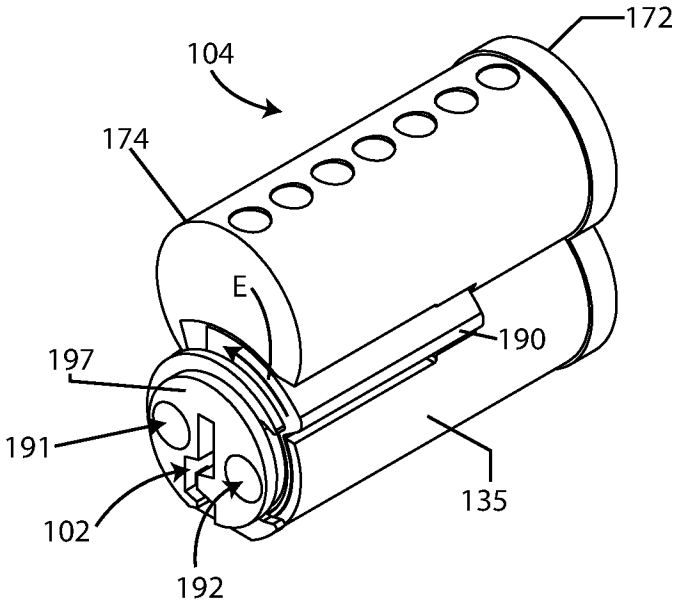
FIGS. 3A and 3B are perspective views of an interchangeable core of the locking device of FIG. 1A in accordance with an embodiment of the present disclosure.
Figure 3A:
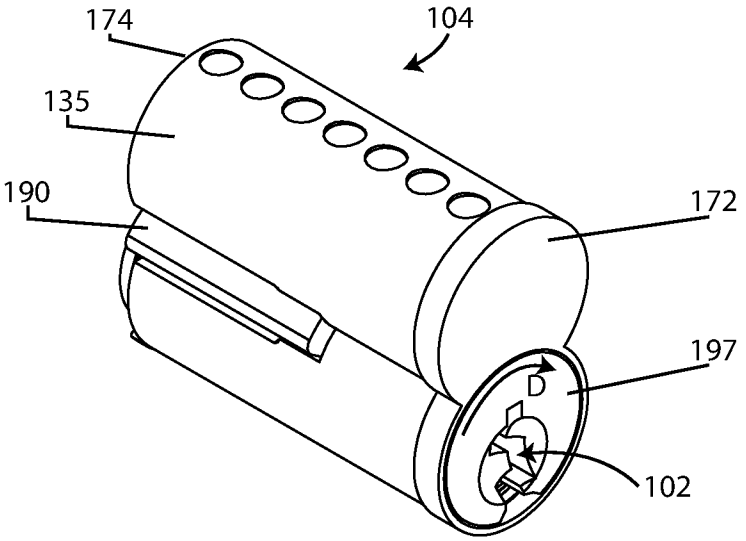

Referring to FIGS. 3A and 3B, perspective views of SFIC 104 are shown in accordance with the present disclosure. As shown in FIGS. 3A and 3B, SFIC 104 includes an SFIC housing 135 having ends 172 and 174. A cylinder 197 extends along the longitudinal axis 120 from end 172 to end 174 of SFIC 104. Key hole or keyway 102 is disposed through cylinder 197 from ends 172, 174 along longitudinal axis 120. SFIC 104 also includes an engaging element 190 and channels 191, 192, where channels 191, 192 extend along longitudinal axis 120 into the interior of SFIC 104. When a proper or operating key is inserted into key hole 102 of SFIC 104, a plurality of tumblers within SFIC 104 align to allow cylinder 197 to be rotated (e.g., in a direction D, as shown in FIG. 3A) to lock and unlock device 100, as will be described in greater detail below.

In one embodiment, when a master or control key (different than the key used to lock and unlock locking device 100) is inserted into key hole 102 and rotated, SFIC 104 is configured such that engaging element 190 may be drawn toward the interior of SFIC 104, as indicated by arrow E in FIG. 3B. It is to be appreciated that SFIC 104 includes a spring or coil within the interior of SFIC 104 that biases engaging element 190 in a direction opposite to arrow E away from SFIC 104 (i.e., perpendicularly to the longitudinal axis 120). Although not shown, the interior 116 of barrel 118 includes a slot configured to receive engaging element 190 to retain SFIC 104 in interior 116. When a master or control key is inserted into key hole 102 and rotated, engaging element 190 is released from the slot in interior 116 allowing SFIC 104 to be removed and to be rekeyed.

Figure 4A:
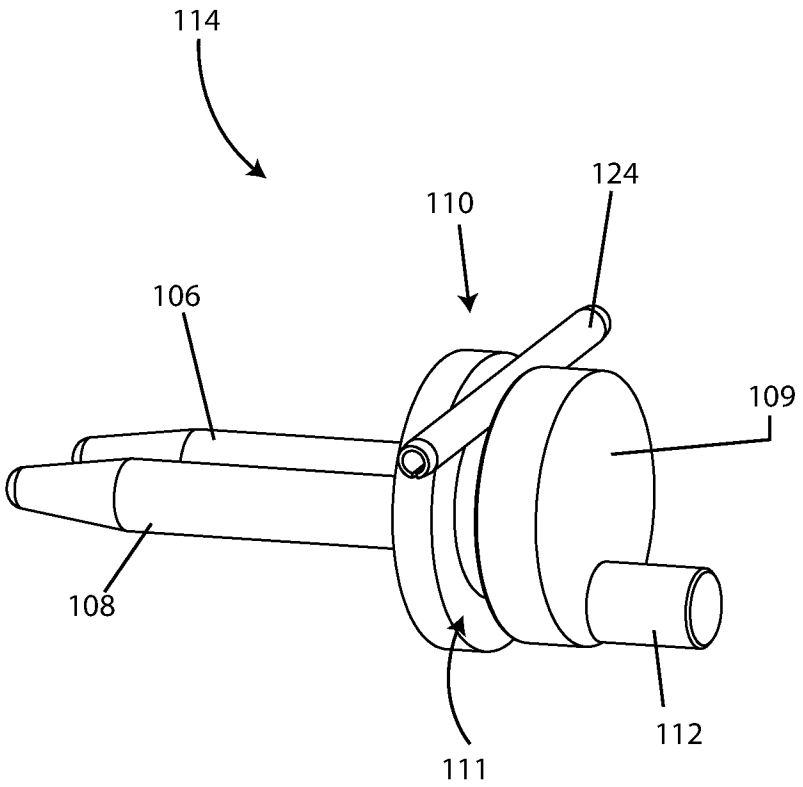
FIG. 4A is a perspective view of a prong driver of the locking device of FIG. 1A in accordance with an embodiment of the present disclosure.

Referring again to FIGS. 2A and 2B, driver 114 includes a circular plate or base 110, having opposite surfaces 107 and 109. Prongs 106 and 108 are coupled to plate 110 of driver 114, where prongs 106 and 108 extend perpendicularly from surface 107 of plate 110 along longitudinal axis 120. Plate 110 also includes an engaging element 112, where engaging element 112 extends perpendicularly from surface 109 of plate 110 along longitudinal axis 120 in a direction opposite to prongs 106 and 108. Referring to FIG. 4A, plate 110 includes a circular slot 111 disposed between surfaces 106 and 108 and configured to receive a portion of pin 124, as will be described in greater detail below.

Figure 4B:
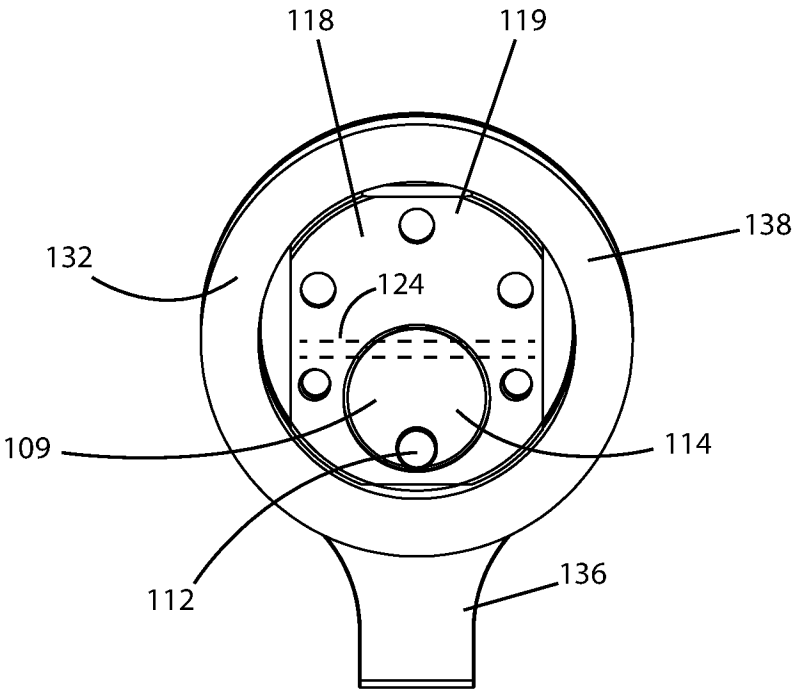
FIG. 4B is a rear view of the locking device of FIG. 1A with several components removed in accordance with an embodiment of the present disclosure.

As shown in FIGS. 2A and 2B, barrel 118 includes ends 113 and 119, where end 119 includes a channel 115. Channel 115 is configured to rotatably retain base 110 of prong driver 114, such that, prongs 106 and 108 extend into channels 191, 192 of SFIC 104. Barrel 118 also includes apertures 123, 125 disposed through outer wall or surface 129 of barrel 118. Each of apertures 123, 125 is configured to receive an end of roll pin 124, such that role pin 124 is disposed perpendicularly to the longitudinal axis 120 within channel 115. Referring to FIG. 4B, a rear view of locking device 100 is shown with retention plate 140, bolt 144, and backplate 150 removed in accordance with the present disclosure. Pin 124 is shown disposed perpendicularly to the longitudinal axis 120 within channel 115. Pin 124 is configured to interact with slot 111 (best seen in FIG. 4A) of plate 110 to rotatably retain plate 110 of prong driver 114 within channel 115, such that prong driver 110 is rotatable about longitudinal axis 120. When a proper key is inserted into key hole 102 and rotated in a first direction, cylinder 197 is also rotated in the first direction, thereby rotating channels 191, 192 and driver 114 in the first direction. In this way, channel 115, plate 110, slot 111, and pin 124 are configured to facilitate the rotational motion of driver 114 about longitudinal axis 120.

Flange 126, anti-rotation plate 136, and dress sleeve 138, include apertures 127, 137, and 139, respectively. In one embodiment, apertures 127, 137, and 139 are configured to align to receive end 119 of barrel 118, where barrel 118 is disposed through apertures 127, 137, and 139.

As shown in FIGS. 2A and 2B, end 113 of barrel 118 includes a front plate 117. In one embodiment, front plate 117 is circular and protrudes from the outer wall 129 of barrel 118. Flange 126 includes a first inner surface 120 and a second inner surface 121. Inner surface 121 has a smaller diameter than inner surface 120, such that, a shoulder tab or ledge 123 is formed. The diameter of the inner surface 121 is configured to securely fit around the contours of outer wall 129, while the diameter of inner surface 120 is configured to securely fit around the contours of faceplate 117. In this way, flange 126 is configured to be coupled to front plate 117 of barrel 118, such that, front plate 117 interacts with shoulder tab 123 of flange 126 to prevent flange 126 from sliding passed side 113 of barrel 118 along longitudinal axis 120.

Anti-rotation plate 136 includes aperture 137 defined by a rim 130. It is to be appreciated that rim 130 is configured to fit very securely around the contours of the outer surface 129 of barrel 118, such that if barrel 118 is rotated, anti-rotation plate 136 is also rotated. Alternatively, if anti-rotation plate 136 is held in place, barrel 118 cannot be rotated. For example, in one embodiment, rim 130 includes flat portions 115, and curved portions 116. Portions 115, 116 of rim 130 are configured to contact at least some of the flat portions 142 and curved portions 134, respectively, of barrel 118 when barrel 118 is disposed through aperture 137. Since rim 130 is configured with flat portions 115 and curved portions 116 to fit at least some of the unique combinations of flat portions 142 and curved portions 134 of outer wall 129, barrel 118 cannot be rotated without also rotating anti-rotation plate 136. It is to be appreciated that in other embodiments, the outer wall 129 of barrel 118 may be configured in different shapes and in each of these embodiments rim 130 of anti-rotation plate 136 is configured to securely fit the unique contours of outer wall 129, such that, if barrel 118 is rotated, anti-rotation plate 136 is also rotated.

Anti-rotation plate 136 also includes an extension member 133 and tab 135. Extension member 133 extends perpendicularly to longitudinal axis 120, such that, tab 135 is disposed exterior to locking device 100 (best seen in FIGS. 1A and 1B). Tab 135 extends from extension member 133 in a direction parallel to longitudinal axis 120 toward end 113 of barrel 118. As will be described in greater detail below, tab 135 is configured to interact with an edge of a structure that locking device 100 is mounted to prevent locking device 100 from being rotated.

It is to be appreciated that, as shown in FIGS. 1A and 1B, when locking device 100 is assembled, a circular gap or slot 170 is formed between anti-rotation plate 136 and flange 126 and exterior to outer wall 129 of barrel 118. As described in greater detail below, slot 170 is configured to receive the circumference of an aperture of a structure (e.g., a door), such that, barrel 118 is disposed through the aperture of the structure and locking device 100 is mounted to the structure.

As shown in FIGS. 2A and 2B, bolt retention plate 140 is coupled to backplate 150, end 132 of sleeve 138, and end 119 of barrel 118. In one embodiment, end 119 of barrel 118 includes apertures 105, retention plate 140 includes apertures 143, and backplate 150 includes apertures 161, such that assembly screws 160 are disposed through each of apertures 105, 143, 161 to fixedly coupled barrel 118, retention plate 140, and backplate 150 together. In some embodiments, back plate 150 further includes tabs 153, which are configured to extend through apertures 147 and 103 of retention plate 140 and barrel 118, respectively, to further secure retention plate 140 and barrel 118 to backplate 150.

Sleeve 138 is disposed over outer wall 129 of barrel 118, such that end 131 of sleeve 138 is disposed adjacent to anti-rotation plate 136 and end 132 of sleeve 138 is disposed adjacent to retention plate 140. Since backplate 150 is fixedly coupled to end 119 of barrel 118, sleeve 138 is prevented from sliding over outer wall 129 along longitudinal axis 120 in a direction toward backplate 150. Since anti-rotation plate 136 is disposed adjacent to side 131 of sleeve 138, anti-rotation plate 136 is also prevented from sliding over outer wall 129 along longitudinal axis 120 in a direction toward backplate 150.

A bolt 144 is slidably disposed in a slot 152 of backplate 150. Bolt 144 is held in slot 152 by bolt retention plate 140, which is disposed between backplate 150 and end 132 of sleeve 138. Bolt 144 includes a slot 145. When barrel 118 is disposed through aperture 139 of sleeve 138, engaging element 112 of prong driver 114 is disposed through aperture 141 of retention plate 140 and into slot 145 of bolt 144. In this way, when a proper key is inserted into key hole 102 and turned, prong driver 114 is rotated, causing engaging element 112 of prong driver 114 to be rotated to extend and retract bolt 144 within slot 152.

Figure 5A:
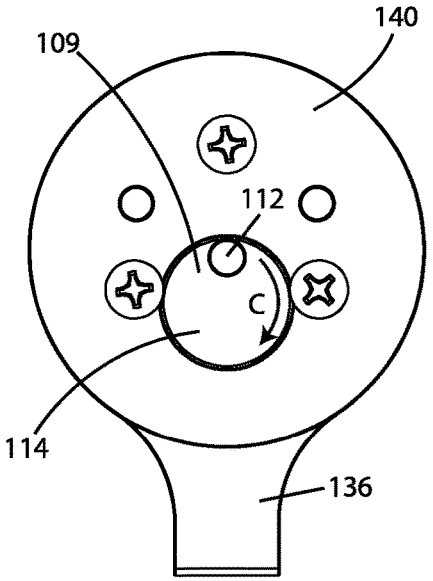
Figure 5C:
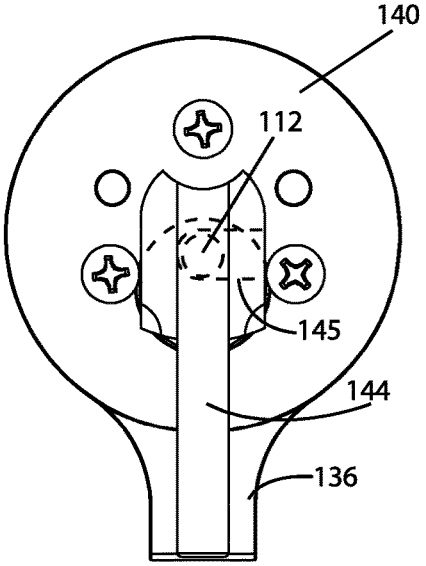
FIGS. 5C and 5D are rear views of the locking device of FIG. 1A in a locked position in accordance with an embodiment of the present disclosure.
Figure 5C:
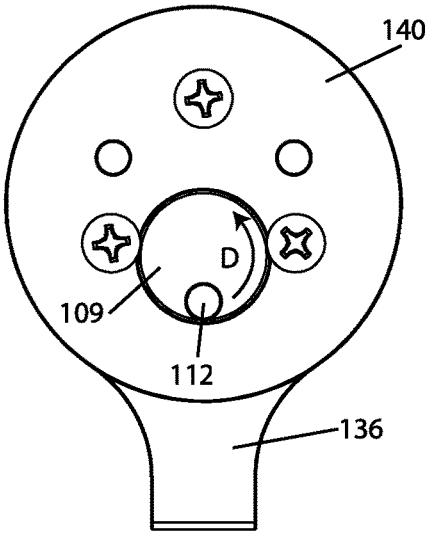
Figure 5D:
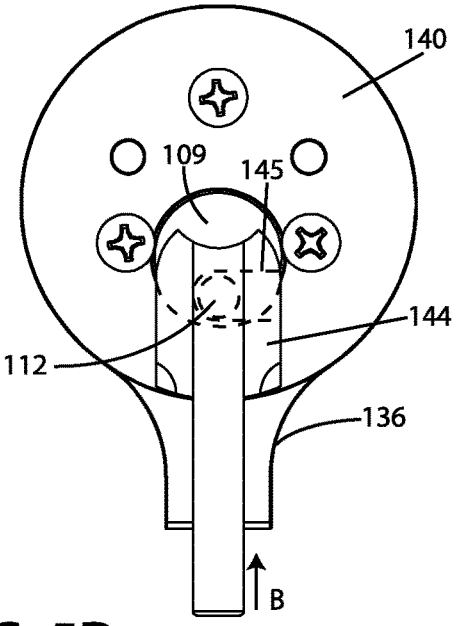

For example, referring to FIGS. 1A, 1B, 5A, 5B, 5C, 5D, the locking and unlocking of device 100 is shown. When locking device 100 is in an unlocked position (as shown in FIGS. 1B, 5A, and 5B) bolt 144 is retracted within slot 152. To lock locking device 100, a proper key is inserted into key hole 102 and rotated in a direction C to rotate engaging element 112 of prong driver 114 in direction C. When engaging element 112 is rotated in a direction C (as shown in FIGS. 5A and 5B), engaging element 112 causes bolt 144 to move in a direction A away from slot 152 toward the exterior of locking device 100, enabling locking device 100 to achieve a locked position, as shown in FIG. 1A. From the locked position, the proper key can be rotated in an opposite direction D (shown in FIGS. 1B, 5C and 5D) to cause engaging element 112 to draw bolt 144 in a direction B toward the interior of slot 152 and locking device 100 to achieve an unlocked position, as shown in FIG. 1B.

Figure 6A:
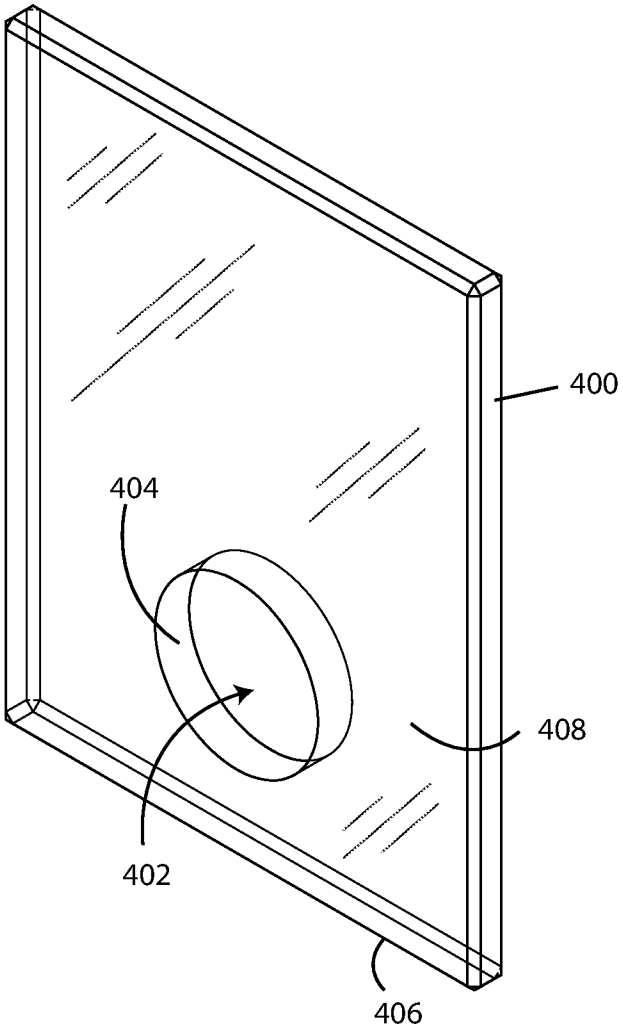
FIG. 6A is a perspective view of an exemplary structure in accordance with an embodiment of the present disclosure.
Figure 6B:
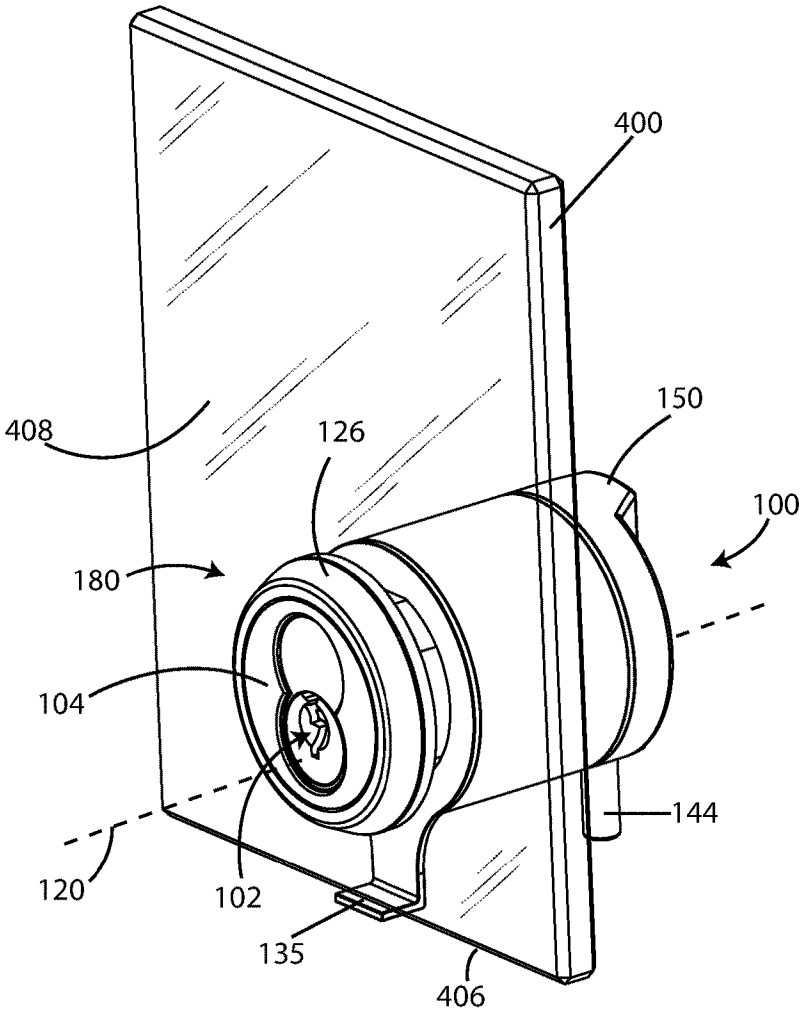
FIGS. 6B-6C are perspective views of the locking device of FIG. 1A mounted to the structure of FIG. 6A in accordance with an embodiment of the present disclosure.
Figure 6C:
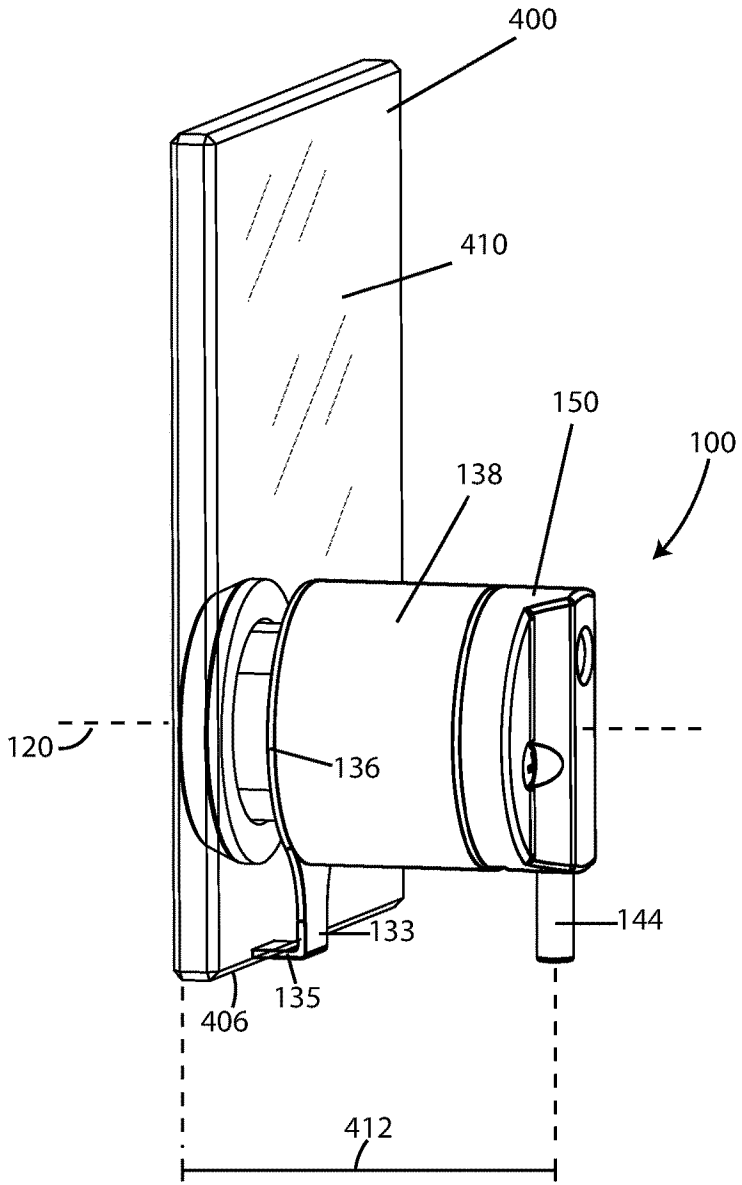

In one embodiment, locking device 100 is configured to be mounted to a door or other structure, e.g., a door of a showcase display cabinet. It is to be appreciated that locking device 100 is configured for use with structures made of glass, wood, metal, etc. For example, referring to FIG. 6A, an exemplary structure 400 that locking device 100 may be mounted to is shown in accordance with the present disclosure. Structure 400 includes sides 408, 410 (side 410 is shown in FIG. 6C), an aperture 402 defined by a circumference or perimeter 404, and an edge 406. Locking device 100 is configured to be disposed through aperture 402 and mounted to structure 400, such that, gap or slot 170 receives the circumference 404 of aperture 402. In this way, only a front portion 180 of locking device 100, including flange 126, plate 117 of barrel 118, and a portion of end 172 of SFIC 104 are disposed on side 408 of structure 400. In one embodiment, side 408 of structure 400 may be a side of a door facing the exterior of a display cabinet. The rest of locking device 100 (i.e., including sleeve 138, backplate 150, and bolt 144) is disposed on side 410 of structure 400. In one embodiment, side 410 of structure 400 may be a side of a door facing the interior of a display cabinet.

When a proper key is inserted into key hole 102 and turned, bolt 144 is advanced in a direction away from locking device 100 into an aperture or securing element (e.g., within a display cabinet), such that the structure 400 (e.g., a cabinet door) cannot be moved. Alternatively, when the proper key is turning in an opposite direction, bolt 144 is advanced in a direction toward locking device 100 to release bolt 144 from the aperture or securing element (e.g., within a display cabinet), such that the structure 400 (e.g., a cabinet door) can be opened again.

As stated above, flange 126 is configured to interact with plate 117, such that, flange 126 is prevented from sliding along longitudinal axis 120 in a direction toward end 113 of barrel 118. Also, sleeve 138 is coupled to backplate 150, such that, sleeve 138 is prevented from sliding along longitudinal axis 120 in a direction toward end 119 of barrel 118. In this way, when locking device is mounted to structure 400, such that, circumference 404 is disposed in slot 170, flange 126 and sleeve 138 are together configured to prevent locking device 100 from being advanced along longitudinal axis 120 in any direction (i.e., toward end 113 or end 119 of barrel 118).

Furthermore, anti-rotation plate 136 is disposed adjacent to side 410 of structure 400, such that, tab 135 is disposed in close proximity to an edge 406 of structure 400. Tab 135 is configured to engage end 406, such that, locking device 100 cannot be rotated about longitudinal axis 120 when locking device 100 is mounted to structure 400. If an attempt is made to rotate locking device 100 while locking device 100 is mounted to structure 400, anti-rotation plate 135 will also be rotated, and tab 135 will meet the edge of structure 400, blocking further rotation of the locking device 100. It is to be appreciated that extension member 133 enables tab 135 to be disposed exterior to locking device 100, such that, tab 135 is enabled to interact with edge 406.

As shown in FIG. 6C, since slot 170 is disposed toward front portion 180 of device 100, when device 100 is mounted to structure 400, bolt 144 is disposed a predetermined distance 412 from structure 400. The distance 412 between bolt 144 and structure 400 is configured to make it more difficult for the bolt 144 to be cut or otherwise compromised by attempts to unlock locking device 100 without the use of a proper key. For example, if structure 400 is a glass door of a display cabinet, bolt 144 is disposed predetermined distance 412 within the interior of the cabinet, making it more difficult to access bolt 144 in an attempt to compromise locking device 100.

In this way, locking device 100 is designed with several safety features: (1) Flange 126 and sleeve 138, are together configured to prevent locking device 100 from sliding in any direction along longitudinal axis 120, (2) anti-rotation plate 138 is configured to prevent locking device 100 from being rotated about longitudinal axis 120, and (3) the predetermined distance 412 that bolt 144 is disposed away from structure 400 increases the difficulty in compromising with bolt 144.

Figure 7A:
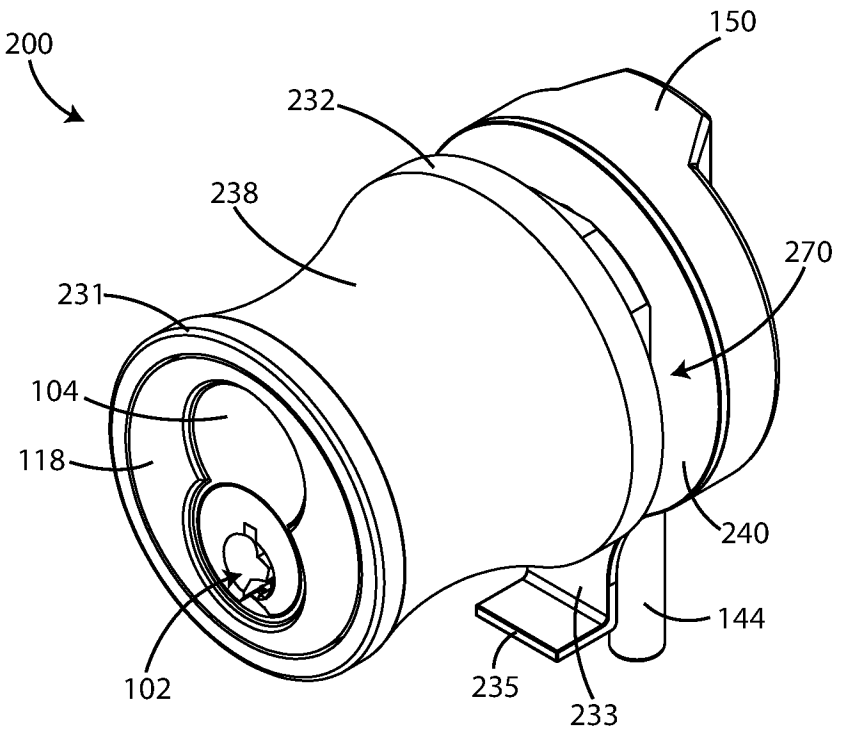
FIG. 7A is a perspective view of another locking device in a locked position in accordance with an embodiment of the present disclosure.
Figure 7B:
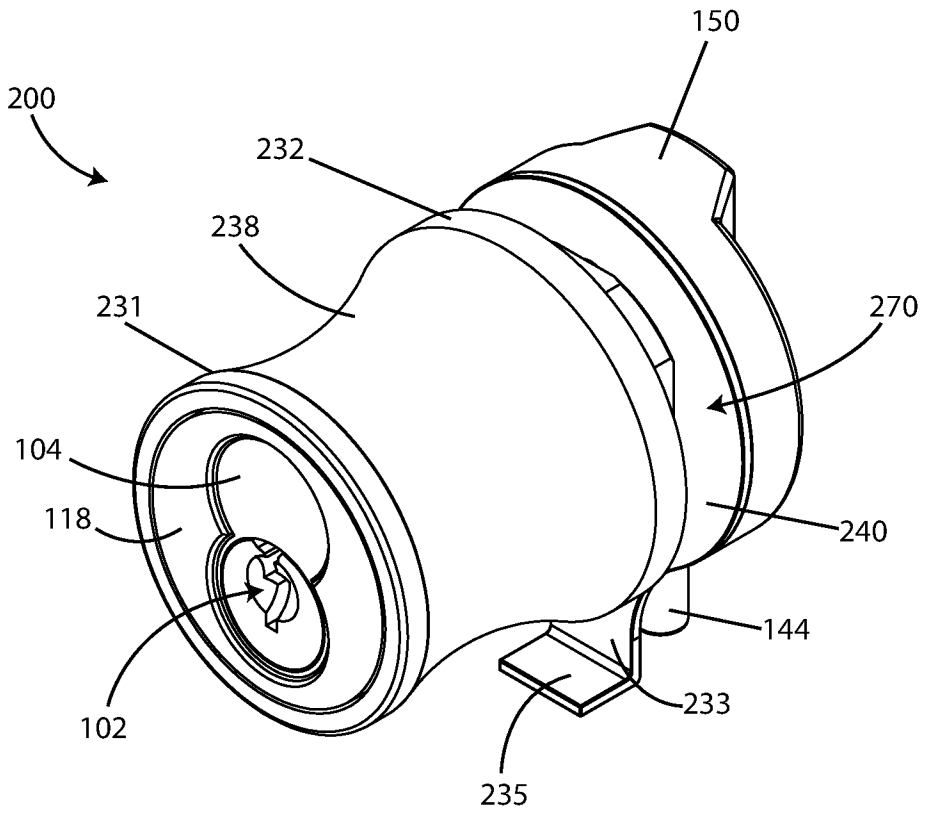
FIG. 7B is a perspective view of the locking device of FIG. 7A in an unlocked position in accordance with an embodiment of the present disclosure.

In an alternative embodiment, locking device 100 may be configured as a knob-style lock. For example, a knob style locking device 200 is shown in FIGS. 7A and 7B, where FIG. 7A shows locking device 200 in a locked position and FIG. 7B shows locking device 200 in an unlocked position in accordance with an embodiment of the present disclosure.

Figure 8A:
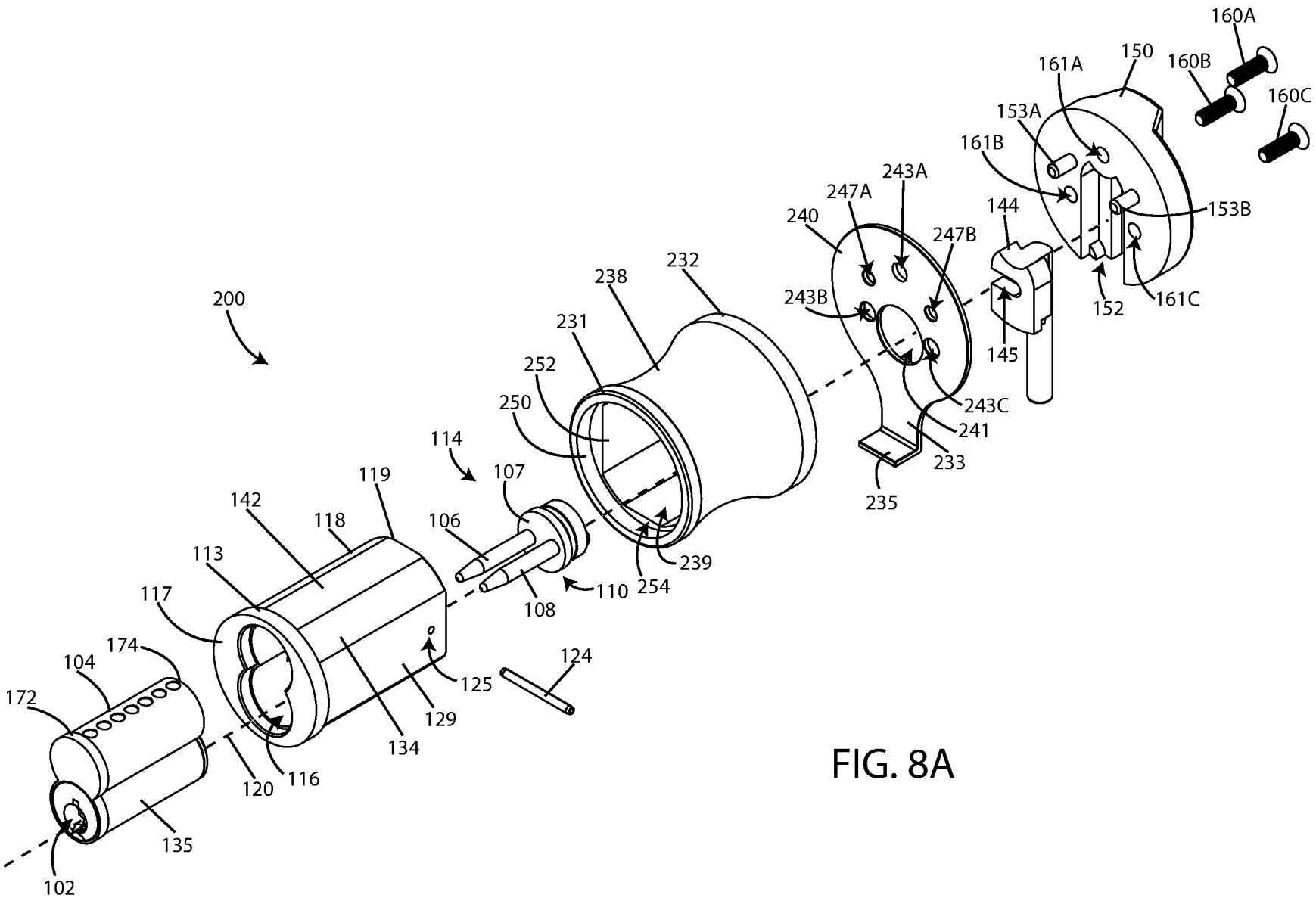
FIGS. 8A and 8B are exploded views of the locking device of FIG. 7A in accordance with an embodiment of the present disclosure.
Figure 8B:
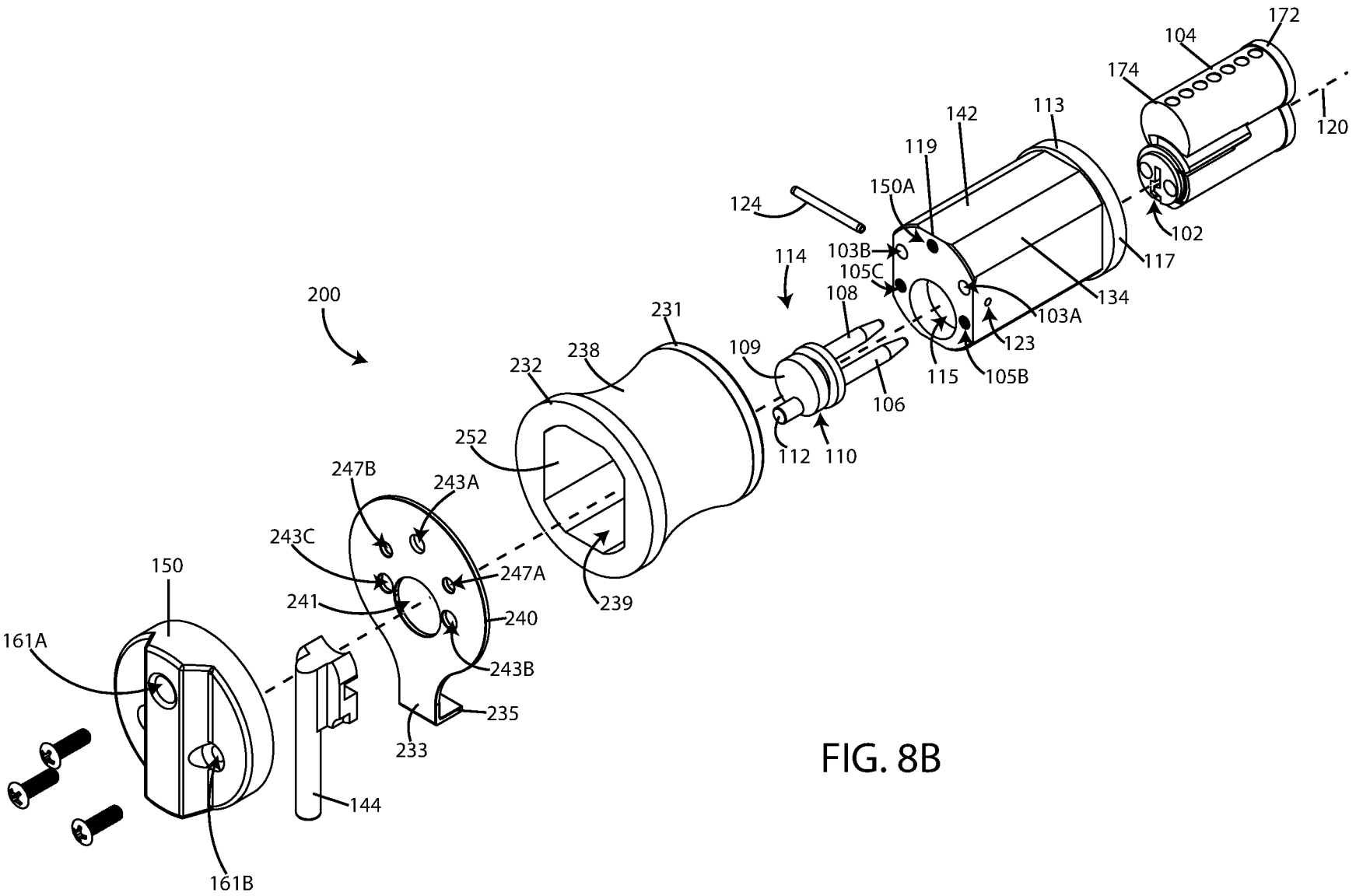

Referring to FIGS. 8A and 8B, exploded perspective views of the locking device 200 are shown in accordance with the present disclosure. It is to be appreciated that locking device 200 includes SFIC 104, barrel 118, pin 124, prong driver 114, bolt 144, backplate 150, and assembly screws 160 of the locking device 100, described above. However, instead of flange 126, anti-rotation plate 136, sleeve 138, and bolt retention plate 140 of locking device 100, locking device 200 includes knob sleeve 238 and combo anti-rotation plate/bolt retainer 240.

Knob sleeve 238 includes ends 231 and 232 and is disposed along longitudinal axis 120. Sleeve 238 includes a hollow interior 239, defined by inner wall 252. End 231 includes an inner surface 250 with a larger diameter than inner surface 252, such that a slot 254 is formed. End 119 of barrel 118 is disposed through interior 239 of sleeve 238, such that, face plate 117 is disposed in slot 254 and sleeve 238 is disposed over outer wall 129 of barrel 118. Slot 254 is configured to interact with faceplate 117, such that, sleeve 238 is prevented from sliding along longitudinal axis 120 in a direction passed end 113 of barrel 118. In one embodiment, inner surface 252 is configured to fit the unique contours (i.e., curved portions 134 and flat portions 142) of outer wall 129, such that, when sleeve 238 is disposed over outer wall 129 of barrel 118, sleeve 238 cannot be rotated without also rotating barrel 118.

Combo anti-rotation plate/bolt retainer 240 includes apertures 241, 243, 247, extension member 233, and tab 235. Combo anti-rotation plate/bolt retainer 240 is coupled to backplate 150 and barrel 118 via assembly screws 160 and tabs 153. For example, one or more screws 160 are disposed through apertures 161, 243, and 105, such that, barrel 118, combo anti-rotation plate/bolt retainer 240, and backplate 150 are fixedly coupled to each other. Also, tabs 153 are disposed through apertures 247 and 103. Combo anti-rotation plate/bolt retainer 240 is coupled to backplate 150, such that, bolt 144 is slidably retained in slot 152. Engaging element 112 of prong driver 114 extends through aperture 241 of combo anti-rotation plate/bolt retainer 240 and into slot 145. In this way, when a proper key is inserted into key hole 102 and turned, prong driver 114 is rotated, causing the projection of prong driver 114 to be rotated. When the projection of prong driver 114 is rotated, the projection of prong driver 114 causes bolt 144 to move in a direction away from slot 152, enabling locking device 200 to achieve a locked position, as shown in FIG. 7A. From the locked position, the proper key can be rotated in an opposite direction to draw bolt 144 in a direction toward locking device 100 to achieve an unlocked position, as shown in FIG. 7B.

Combo anti-rotation plate/bolt retainer 240 includes an extension member 233, which extends perpendicularly to longitudinal axis 120. Tab 235 is coupled to extension members 233, such that, tab 235 is disposed exterior to locking device 200. Tab 235 extends perpendicularly to extension member 233 and along longitudinal axis 120. It is to be appreciated that since combo anti-rotation plate/bolt retainer 240 is fixedly coupled to backplate 150, combo anti-rotation plate/bolt retainer 240 is prevented from sliding along longitudinal axis 120 in any direction.

As shown in FIGS. 7A and 7B, when locking device 200 is fully assembled, a circular slot 270 is formed between combo anti-rotation plate/bolt retainer 240 and end 232 of sleeve 238. In one embodiment, locking device 200 is configured to be mounted to a door or other structure 400 (as shown in FIG. 6A), e.g., a door of a showcase display cabinet. It is to be appreciated that locking device 200 is configured for use with structures made of glass, wood, metal, etc. For example, locking device 200 is configured to be disposed through aperture 402 and mounted to structure 400, such that, gap or slot 270 receives the circumference 404 of aperture 402. In this way, the portion of locking device 200, including barrel 118, SFIC 104, and sleeve 238 is disposed on side 408 of structure 400. As described above, side 408 of structure 400 may be a side of a door facing the exterior of a display cabinet. The rest of locking device 200 (i.e., including combo anti-rotation plate/bolt retainer 240, backplate 150, and bolt 144) is disposed on side 410 of structure 400. As described above, side 410 of structure 400 may be a side of a door facing the interior of a display cabinet.

It is to be appreciated, that a proper key may be inserted into key hole 102 and rotated to advance or retract bolt 144, such that, bolt 144 engages or disengages a securing element of structure 400 (e.g., disposed within a display cabinet) to prevent or allow structure 400 to be moved.

As stated above, slot 254 of sleeve 238 is configured to interact with plate 117, such that, sleeve 238 is prevented from sliding along longitudinal axis 120 in a direction toward end 113 of barrel 118. Also, combo anti-rotation plate/bolt retainer 240 is coupled to backplate 150, such that, combo anti-rotation plate/bolt retainer 240 is prevented from sliding along longitudinal axis 120 in a direction toward end 119 of barrel 118. In this way, when locking device 200 is mounted to structure 400, such that, circumference 404 is disposed in slot 270, sleeve 238 and combo anti-rotation plate/bolt retainer 240 are together configured to prevent locking device 200 from being advanced along longitudinal axis 120 in any direction (i.e., toward end 113 or end 119 of barrel 118).

Furthermore, combo anti-rotation plate/bolt retainer 240 is disposed adjacent to side 410 of structure 400, such that, tab 235 is disposed in close proximity to edge 406 of structure 400. Tab 235 is configured to engage edge 406, such that, locking device 200 cannot be rotated about longitudinal axis 120 when locking device 200 is mounted to structure 400. If an attempt is made to rotate locking device 200 while locking device 200 is mounted to structure 400, combo anti-rotation plate/bolt retainer 240 will also be rotated, and tab 235 will meet edge 406 of structure 400, blocking further rotation of the locking device 200. It is to be appreciated that extension member 233 enables tab 235 to be disposed exterior to locking device 200, such that, tab 235 is enabled to interact with edge 406.

Figure 9A:
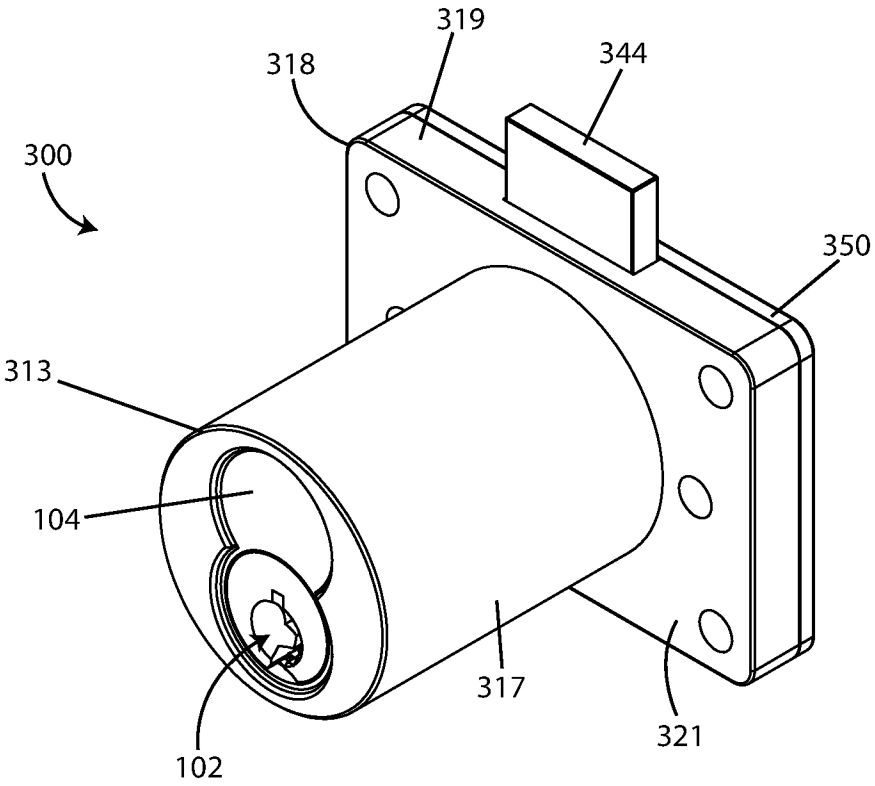
FIG. 9A is a perspective view of another locking device in a locked position in accordance with an embodiment of the present disclosure.
Figure 9B:
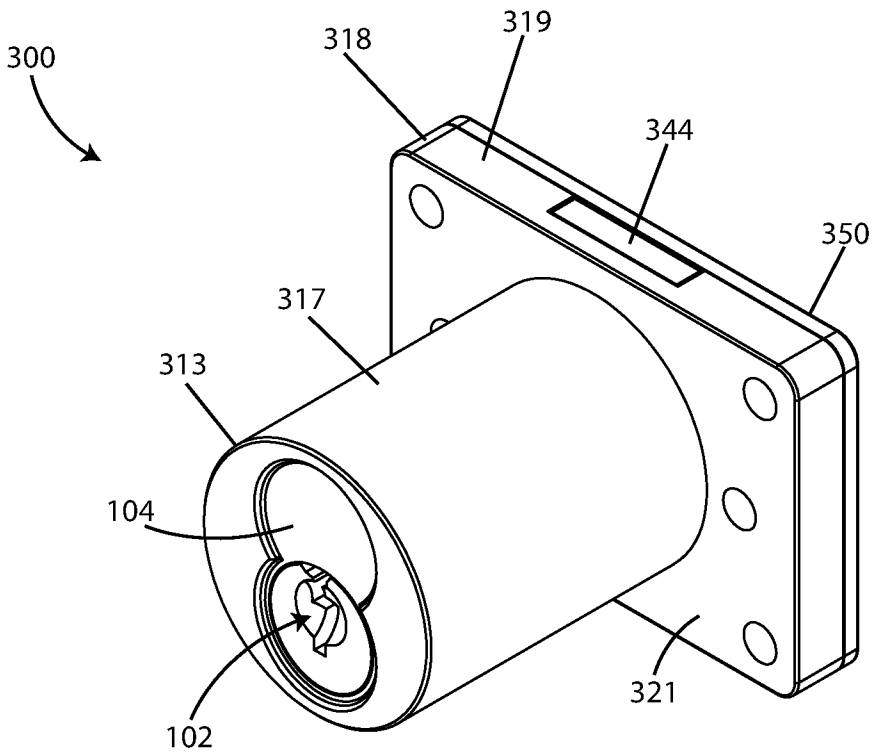
FIG. 9B is a perspective view of the locking device of FIG. 9A in an unlocked position in accordance with an embodiment of the present disclosure.

Referring to FIGS. 9A and 9B, a locking device 300 is shown in accordance with an embodiment of the present disclosure, where FIG. 9A shows a perspective view of locking device 300 in a locked position and FIG. 9B shows a perspective view of locking device 300 in an unlocked position.

Figure 10A:
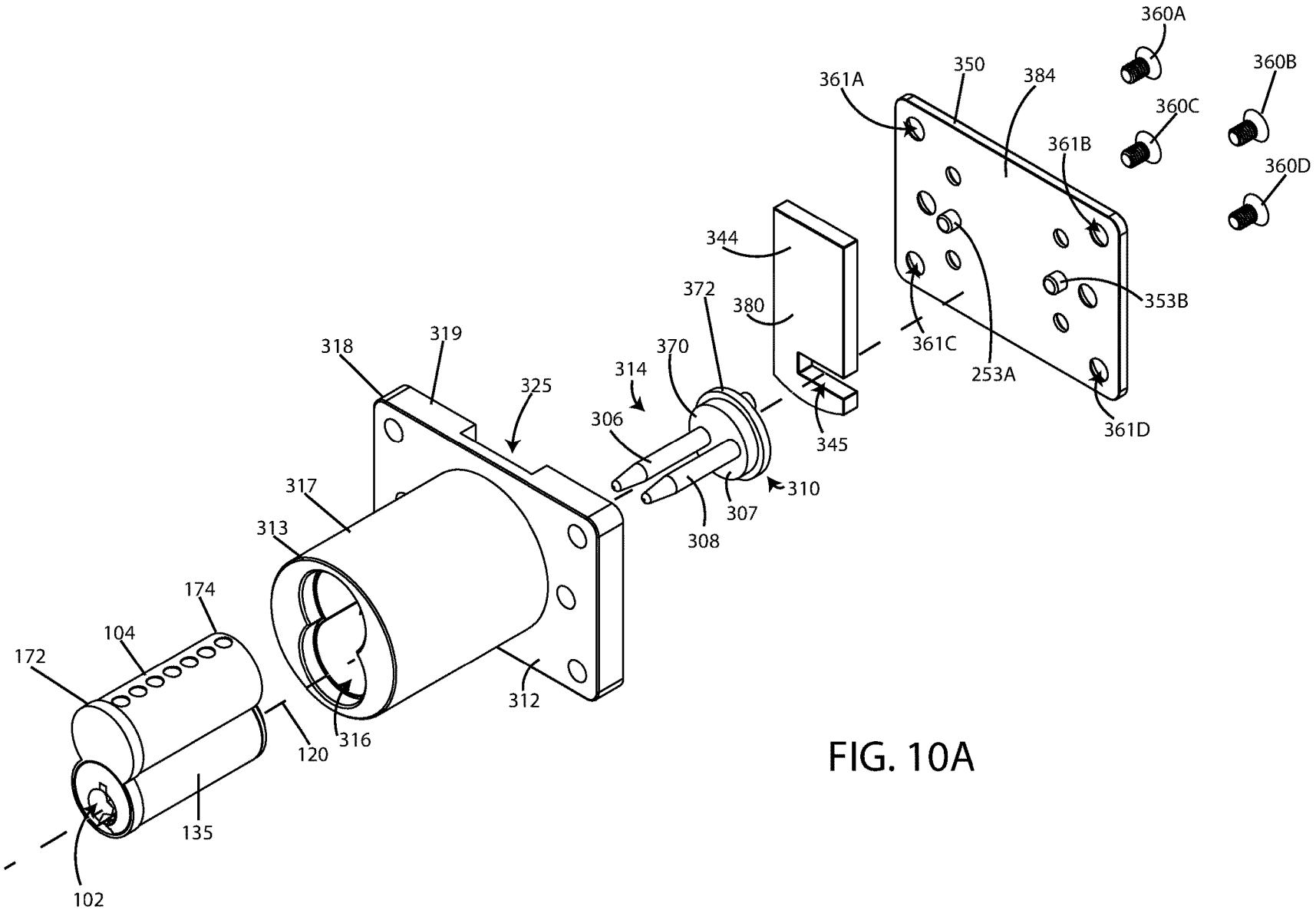
FIGS. 10A and 10B are exploded views of the locking device of FIG. 9A in accordance with an embodiment of the present disclosure.
Figure 10B:
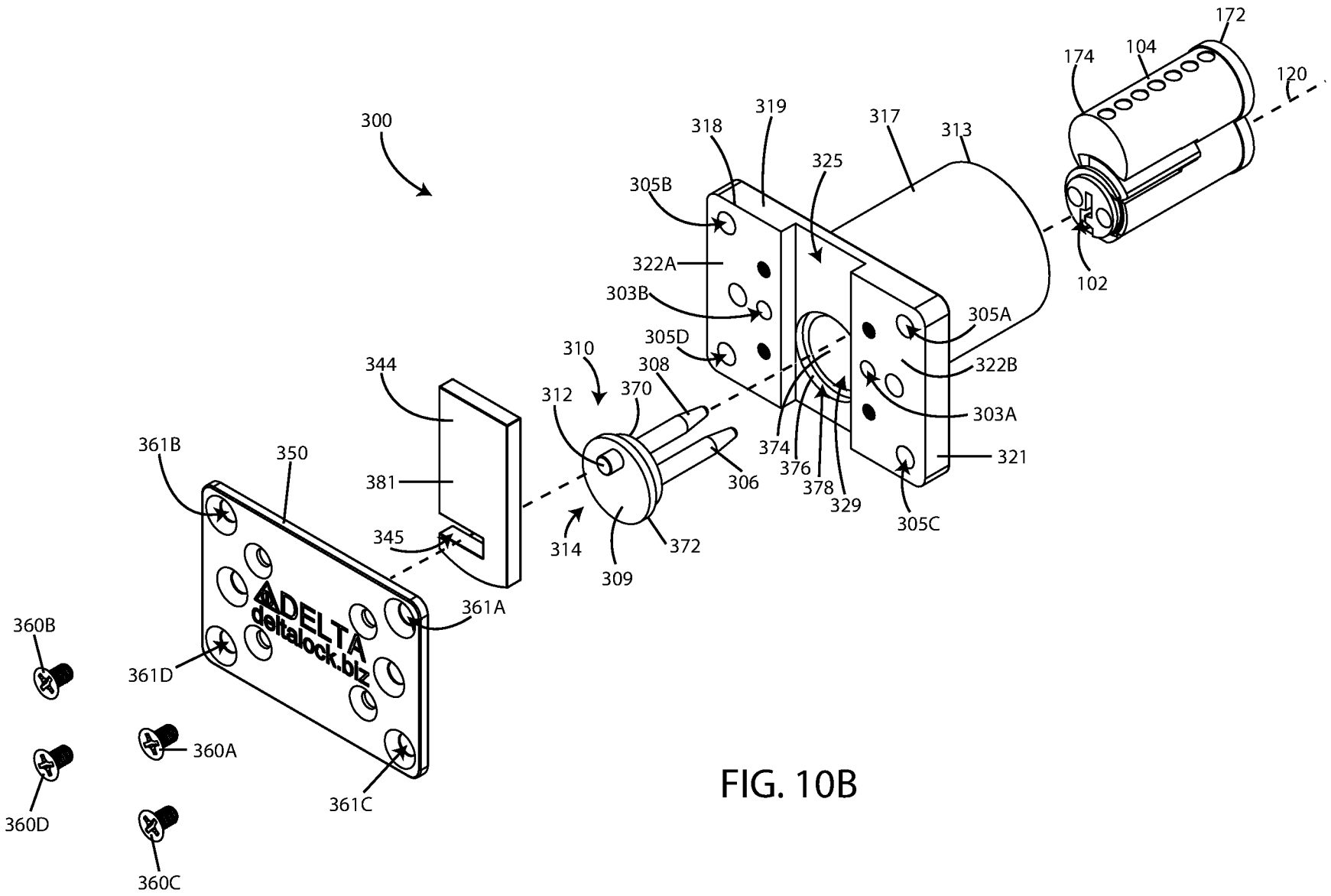

Referring to FIGS. 10A and 10B, exploded perspective views of locking device 300 are shown in accordance with the present disclosure. Locking device 300 includes SFIC 104, barrel housing 318, prong driver 314, bolt 344, backplate 350, and assembly screws 360. Barrel housing 318 is disposed along longitudinal axis 120 and includes ends 313, 319 and a hollow interior 316 configured to receive SFIC 104. Although not shown, hollow interior 316 includes a slot configured to receive engaging element 190 of SFIC 104 to allow SFIC 104 to be removed from interior 316 using a master or control key (as described above). End 319 of barrel housing 318 includes a base 321. As shown in FIG. 10B, base 321 includes surfaces 322A, 322B, and 323, where surface 323 is recessed relative to surface 322A, 322B (i.e., surface 323 is disposed closer to end 313 of barrel housing 318 than surfaces 322A, 322B), such that, slot 325 is formed in end 319 of barrel housing 318.

Surface 323 includes a channel 329 extending along longitudinal axis 120 into interior 316 of barrel 317. In one embodiment, channel 329 includes a first circular surface 374 and a second circular surface 376, where surface 376 is disposed closer to end 319 of barrel housing 318 than surface 374. Surface 374 is configured with a smaller diameter than surface 376, such that, a circular slot 378 is formed.

Prong driver 314 includes a base 310, prongs 306, 308, and an engaging element 312. Base 310 includes circular plates 370, 372, where plate 370 includes a surface 307 and plate 372 includes a surface 309. Prongs 306, 308 extend from surface 307 along longitudinal axis 120 in a direction toward end 313 of barrel 317. Engaging element 312 extends from surface 309 along longitudinal axis 120, in a direction opposite to prongs 306, 308.

Prong driver 314 is disposed through channel 329, such that, circular plate 372 is disposed in slot 378 and circular plate 370 is disposed in channel 329. It is to be appreciated that the diameter of circular plate 372 is bigger than the diameter of circular plate 370. The diameter of plate 372 is chosen, such that, plate 372 fits securely within slot 378. Furthermore, the diameter of plate 370 is chosen, such that, plate 370 fits securely within channel 329. Furthermore, the dimensions of plates 370, 372, and slot 378 are chosen, such that, when driver 314 is disposed in channel 329, surface 309 of driver 314 sits flushly (i.e., is aligned with) surface 323 of slot 325.

When driver 314 is disposed in channel 329, prongs 306, 308 extends into channels 191, 192 of SFIC 104. It is to be appreciated that SFIC 104 and prong driver 314 interacts in a similar manner to SFIC 104 and as prong driver 114, described above. In this way, when a proper key is inserted into key hole 102 and rotated, prong driver 314, and thus, engaging element 312 is also rotated.

Bolt 344 is slidably disposed in slot 325. Bolt 344 includes a slot 345 and surfaces 380, 381, where surface 380 is opposite to surface 381. When bolt 344 is disposed in slot 325, engaging element 312 is disposed through slot 345. As described above, when driver 314 is disposed through channel 329, surface 309 is aligned with surface 323. In this way, when bolt 344 is disposed in slot 325, surface 380 of bolt 344 is disposed adjacent to surface 323 of slot 325 and surface 309 of driver 314. Furthermore, when bolt 344 is disposed in slot 325, surface 381 is aligned with surface 322A and 322B.

Locking device 300 further includes backplate 350. Backplate 350 includes one or more apertures 361 and tabs 353. Base 321 further includes apertures 305 and 303, where apertures 305 align with apertures 361 and apertures 303 align with tabs 353. In this way, backplate 350 is secured to base 321 via one or more screws 360 disposed through apertures 361, 305 and one or more tabs 353 disposed through apertures 303.

When backplate 350 is coupled to base 321, surface 384 of backplate 350 is aligned with and comes into contact with surfaces 381, 322A, and 322B. The alignments of surfaces 309, 323, 380, and surface 381, 322A, 322B, and 384, enable bolt 344 to fit very securely within slot 325 and track properly in a direction perpendicular to longitudinal axis 120.

Figure 11A:
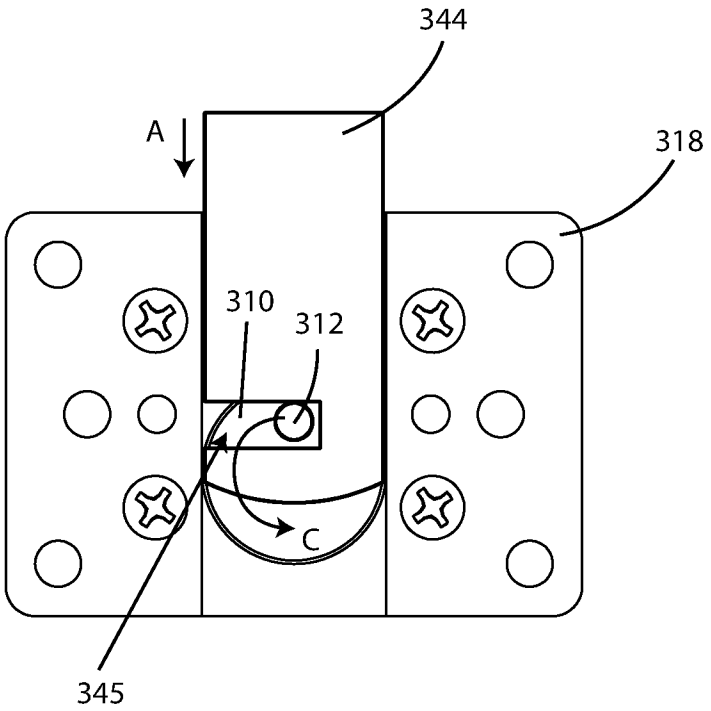
FIGS. 11A and 11B are rear views of the locking device of FIG. 9A with a backplate removed in accordance with an embodiment of the present disclosure.
Figure 11B:
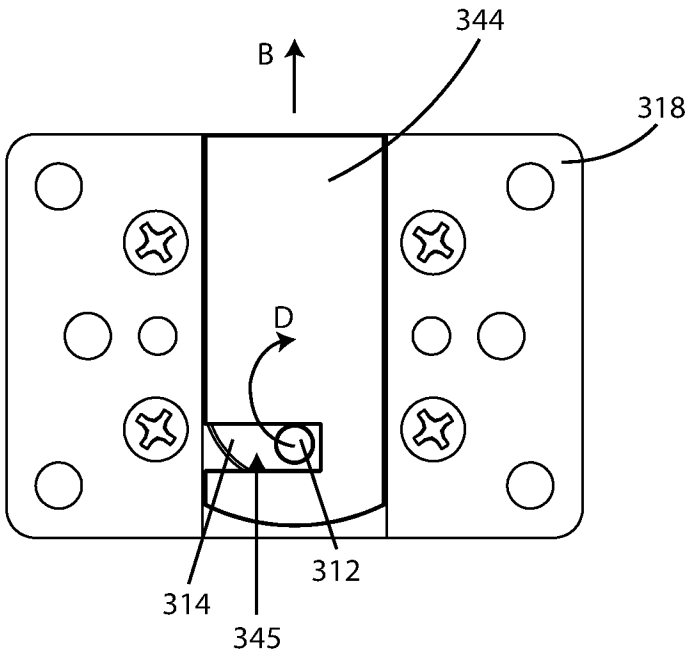

In use, when a proper key is inserted into key hole 302 and turned, prong driver 314 is rotated, causing the projection 312 of prong driver 314 to be rotated and bolt 344 to extend or retract from locking device 300. For example, referring to FIGS. 11A and 11B, when the projection 312 of prong driver 314 is rotated in a direction C, the projection 312 of prong driver 314 causes bolt 344 to move in a direction A toward the interior of slot 325, enabling locking device 300 to achieve an unlocked position, shown in FIGS. 11B and 9B. As shown in FIG. 9B, in the unlocked position, bolt 344 is fully retained in slot 325. From the unlocked position shown in FIGS. 11B and 9B, the proper key can be inserted into key hole 102 and rotated an opposite direction D to extend bolt 344 in a direction B away locking device 300 to achieve a locked position, as shown in FIGS. 11A and 9A.

In one embodiment, locking device 300 is configured to be used as a drawer lock. In this embodiment, the door of the drawer includes an aperture configured to receive end 313 of locking device 300. The aperture of the door has a diameter slightly larger than cylindrical barrel portion 317 of barrel housing 318 (shown in FIGS. 9-10). Base 321 of barrel housing 318 is configured to be coupled to surface of the drawer door facing the interior of the drawer using screws 360. In this way, the end 313 of locking device 300 extends past the surface of the drawer door that faces the exterior of the drawer. In one embodiment, the drawer will include an aperture or securing element in the interior of the drawer configured to receive a portion of bolt 344 extending from slot 325 when locking device 300 is in the locked position. In this way, when locking device 300 is in the locked position, the drawer door cannot be pulled to gain access to the contents of the drawer.

It is to be appreciated that the various features shown and described are interchangeable, that is a feature shown in one embodiment may be incorporated into another embodiment.

While the disclosure has been shown and described with reference to certain preferred embodiments thereof, it will be understood by those skilled in the art that various changes in form and detail may be made therein without departing from the spirit and scope of the disclosure.

Furthermore, although the foregoing text sets forth a detailed description of numerous embodiments, it should be understood that the legal scope of the invention is defined by the words of the claims set forth at the end of this patent. The detailed description is to be construed as exemplary only and does not describe every possible embodiment, as describing every possible embodiment would be impractical, if not impossible. One could implement numerous alternate embodiments, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

What is claimed is:

1. A locking device, comprising:

a barrel housing including a first end, a second end, and a barrel including a hollow interior disposed along a longitudinal axis, the second end of the barrel housing including a base coupled to the barrel, the base including a first slot aligned perpendicularly to the longitudinal axis, the first slot including a first surface, the first surface including a channel aligned along the longitudinal axis into the hollow interior of the barrel, the channel including a first circular surface extending along the longitudinal axis of the barrel and a second circular surface disposed adjacent to the first surface along the longitudinal axis, the first circular surface configured with a diameter smaller than a diameter of the second circular surface such that a circular slot is formed at the first surface;

an interchangeable core disposed in the hollow interior of the barrel via the first end of the barrel housing and including a first end and a second end, the first end including a key hole;

a prong driver including a circular plate, at least one prong and an engaging element, the circular plate including a first surface and a second surface, the at least one prong extending from the first surface and the engaging element extending from the second surface, the prong driver disposed in the channel via the second end of the barrel housing and the at least one prong being coupled to the second end of the interchangeable core, such that, the circular plate is rotatably retained in the circular slot and the second surface of the circular plate is flush with the first surface of the base, and a bolt slidably disposed in the first slot, the bolt including a second slot configured to receive the engaging element of the prong driver, wherein, when a proper key is inserted into the key hole of the interchangeable core and rotated in a first direction, the engaging element of the prong driver is rotated in the first direction to engage the second slot of the bolt to retract the bolt into the first slot in a direction toward the interior of the base and when the prong driver is rotated in the second direction, the engaging element of the prong driver is rotated in the second direction to engage the second slot of the bolt to extend the bolt outside of the base in a direction away from the locking device.

2. The locking device of claim 1, wherein the interchangeable core includes a second engaging element and the hollow interior of the barrel includes a third slot configured to receive the second engaging element, wherein when the second engaging element is disposed in the third slot, the interchangeable core is securely retained in the hollow interior of the barrel housing.

3. The locking device of claim 2, wherein when a master key is inserted into the key hole of the interchangeable core and rotated in the first direction, the second engaging element is released from the third slot to allow the interchangeable core to be removed from the hollow interior of the barrel housing.

4. The locking device of claim 1, wherein the interchangeable core is a small format interchangeable core.

5. The locking device of claim 1, further comprising a backplate coupled to the base, the backplate configured to slidably retain the bolt in the first slot.

6. The locking device of claim 5, wherein the backplate includes a plurality of apertures, at least a portion of the apertures are configured to secure the locking device to a structure.

7. The locking device of claim 1, wherein the base includes a plurality of apertures, at least a portion of the apertures are configured to secure the locking device to a structure.

8. The locking device of claim 7, wherein the structure is a door of a cabinet drawer.

9. The locking device of claim 1, wherein the bolt is generally rectangular.

10. The locking device of claim 7, wherein the structure includes an aperture to receive the barrel and a surface of the base is configured to be coupled to a surface of an interior surface of the structure.

* * * * *